US009348296B2

(12) United States Patent
Kim et al.

(10) Patent No.: US 9,348,296 B2
(45) Date of Patent: May 24, 2016

(54) METHOD OF CONTROLLING IMAGE FORMING APPARATUS CONNECTED TO EXTERNAL DEVICE VIA EXTERNAL DEVICE INTERFACE UNIT AND IMAGE FORMING APPARATUS USING THE SAME

(71) Applicant: Samsung Electronics Co., Ltd., Suwon-si (KR)

(72) Inventors: Jang-geun Kim, Yongin-si (KR); Jie-hwan Park, Hwaseong-si (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 0 days.

(21) Appl. No.: 14/727,083

(22) Filed: Jun. 1, 2015

(65) Prior Publication Data

US 2016/0062302 A1 Mar. 3, 2016

(30) Foreign Application Priority Data

Aug. 28, 2014 (KR) ..... 10-2014-0113347

(51) Int. Cl.
*G03G 15/00* (2006.01)

(52) U.S. Cl.
CPC ..... *G03G 15/80* (2013.01)

(58) Field of Classification Search
None
See application file for complete search history.

(56) References Cited

U.S. PATENT DOCUMENTS

| | | | | |
|---|---|---|---|---|
| 7,859,693 | B2 | 12/2010 | Ueno et al. | |
| 2007/0041742 | A1* | 2/2007 | Kim | G03G 15/205 399/69 |
| 2010/0064148 | A1 | 3/2010 | Ho et al. | |
| 2011/0173473 | A1 | 7/2011 | Cho | |
| 2013/0169990 | A1* | 7/2013 | Yoshioka | H02J 9/061 358/1.14 |
| 2013/0250333 | A1 | 9/2013 | Matsuda | |
| 2014/0029043 | A1 | 1/2014 | Nagami | |
| 2014/0111826 | A1 | 4/2014 | Nakamura | |

OTHER PUBLICATIONS

International Search Report dated Sep. 18, 2015 in International Patent Application No. PCT/KR2015/007124.

* cited by examiner

*Primary Examiner* — Clayton E Laballe
*Assistant Examiner* — Jas Sanghera
(74) *Attorney, Agent, or Firm* — Staas & Halsey LLP

(57) ABSTRACT

A method of controlling an image forming apparatus by driving a control unit by using power supplied from an external device via an external device interface unit, even when main power is not supplied to the image forming apparatus, and an image forming apparatus using the same is provided.

20 Claims, 11 Drawing Sheets

FIG. 5

| Input | | Output | |
|---|---|---|---|
| FIRST POWER | SECOND POWER | POWER FOR CONTROL UNIT | POWER-SUPPLY STATE OF IMAGE FORMING APPARATUS |
| H | H | **H** | L |
| H | L | **H** | L |
| L | H | **H** | **H** |
| L | L | L | L |

METHOD OF CONTROLLING IMAGE FORMING APPARATUS CONNECTED TO EXTERNAL DEVICE VIA EXTERNAL DEVICE INTERFACE UNIT AND IMAGE FORMING APPARATUS USING THE SAME

CROSS-REFERENCE TO RELATED APPLICATIONS

This application claims the priority benefit of Korean Patent Application No. 10-2014-0113347, filed on Aug. 28, 2014, in the Korean Intellectual Property Office, the disclosure of which is incorporated herein in its entirety by reference.

BACKGROUND

1. Field

One or more exemplary embodiments relate to a method of controlling an image forming apparatus connected to an external device via an external device interface unit, and an image forming apparatus using the same.

2. Description of the Related Art

In many cases, a software (SW) power button function is applied to models of image forming apparatuses that have been recently produced, so as to prevent unnecessary power consumption of the image forming apparatuses. In other words, when alternating current (AC) power is supplied to an image forming apparatus, a SW power button needs to be pressed so as to normally supply power to the image forming apparatus, and thus, operate the image forming apparatus. Additionally, in a case of an image forming apparatus to which an auto power-off (APO) function is applied, main power of the image forming apparatus may be automatically turned off after a certain period of time.

There are some cases in which a user requests an image forming apparatus to operate by using an external device connected to the image forming apparatus, even though the user does not recognize that the main power of the image forming apparatus is in an OFF state.

SUMMARY

One or more exemplary embodiments include a method of controlling an image forming apparatus by using power supplied from an external device via an external device interface unit, even when main power is not supplied to the image forming apparatus, and an image forming apparatus using the same.

According to one or more exemplary embodiments, an image processing apparatus includes: a power supply to generate power for the image processing apparatus; an external device interface unit to connect an external device to the image forming apparatus; a driving unit to generate power, by using first power supplied from the power supply or second power supplied from the external device via the external device interface unit; and a control unit which is driven by the generated power and which generates information about a power-supply state of the image forming apparatus based on whether the first power is supplied or whether the second power is supplied, wherein the driving unit generates the power for the control unit by using the second power, if supply of the first power is obstructed.

The control unit may receive a request for the information about the power-supply state of the image forming apparatus from the external device and the control unit may transmit the generated information about the power-supply state of the image forming apparatus to the external device.

The generated information about the power-supply state of the image forming apparatus may indicate that the supply of the first power is obstructed.

The image processing apparatus may further include an image forming unit to execute a print job, wherein, if the control unit receives the print job from the external device, the control unit controls the power supply to supply a plurality of pieces of power including the first power to the image forming apparatus and the control unit controls the image forming unit to perform the print job.

The image processing apparatus may further include a user interface unit configured to receive input from user manipulation, wherein the control unit controls the power supply to resume the supply of the first power, if the user manipulation is input to the user interface unit.

The control unit may transceive information with the external device via the external device interface unit, if the external device is turned on and the second power is supplied from the external device via the external device interface unit.

The control unit may control warm-up of the image forming apparatus, after the plurality of pieces of power including the first power are supplied from the power supply to the image forming apparatus.

The control unit may include: a power-supply state detection unit which generates information about the power-supply state of the image forming apparatus, based on the whether the first power is supplied or the whether the second power is supplied; a power-supply state transceiving unit which receives a request for the information about the power-supply state of the image forming apparatus from the external device; and a central processing unit (CPU) which transceives the generated information about the power-supply state of the image forming apparatus to the external device via the power-supply state transceiving unit, in response to the request for the information about the power-supply state of the image forming apparatus.

The CPU may include a register for storing the generated information about the power-supply state of the image forming apparatus.

The external device interface unit may be a universal serial bus (USB) interface unit.

According to one or more exemplary embodiments, a method of controlling an image processing apparatus connected to an external device via an external device interface unit includes: generating power by using second power supplied from the external device via the external device interface unit, if supply of first power supplied from a power supply is obstructed; and driving a control unit by the generated power and generating information about a power-supply state of the image forming apparatus based on whether the first power is supplied or whether the second power is supplied.

The method may further include: receiving a request for the information about the power-supply state of the image forming apparatus from the external device, and transmitting the generated information about the power-supply state of the image forming apparatus to the external device.

The generated information about the power-supply state of the image forming apparatus may indicate that the supply of the first power is obstructed.

The method may further include: controlling the image forming apparatus to supply a plurality of pieces of power including the first power to the image forming apparatus, if a print job is received from the external device; and controlling an image forming unit to execute the received print job.

The method may further include controlling the power supply to resume the supply of the first power, if user manipulation is input to a user interface unit for inputting user manipulation.

The generating of the power for the control unit may include receiving the second power from the external device via the external device interface unit, if the external device is turned on; generating the power for the control unit by using the supplied second power, and further comprising transceiving of information with the external device via the external device interface unit.

The method may further include controlling warming-up of the image forming apparatus, after the plurality of pieces of power including the first power are supplied from the power supply to the image forming apparatus.

The method may further include storing the generated information about the power-supply state of the image forming apparatus.

The external device interface unit may be a universal serial bus (USB) interface unit.

According to an aspect of one or more embodiments, there is provided at least one non-transitory computer readable medium storing computer readable instructions to implement methods of one or more embodiments.

BRIEF DESCRIPTION OF THE DRAWINGS

These and/or other aspects will become apparent and more readily appreciated from the following description of exemplary embodiments, taken in conjunction with the accompanying drawings in which:

FIG. 5 is a diagram for explaining output from a driving unit and a power-supply state detection unit according to whether or not first power is supplied or whether or not second power is supplied;

DETAILED DESCRIPTION

Figure 1:
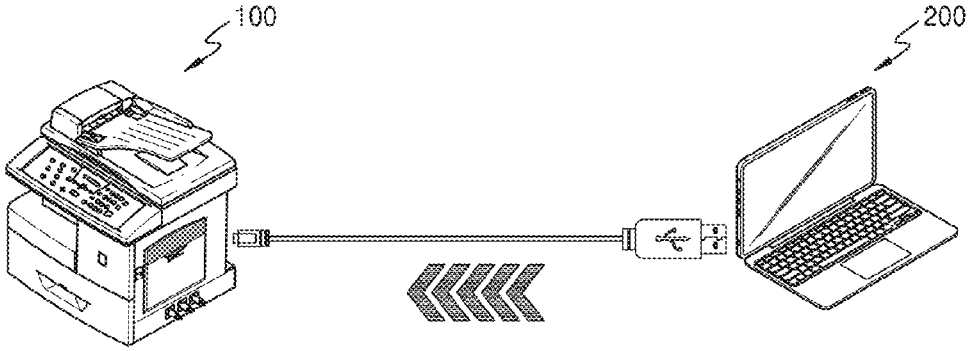
FIG. 1 is a diagram illustrating a connection of an image processing apparatus to an external device.

Reference will now be made in detail to exemplary embodiments, examples of which are illustrated in the accompanying drawings, wherein like reference numerals refer to like elements throughout. Exemplary embodiments may have different forms and should not be construed as being limited to the descriptions set forth herein. Accordingly, exemplary embodiments are merely described below, by referring to the figures, to explain aspects of the present description. As used herein, the term "and/or" includes any and all combinations of one or more of the associated listed items. Expressions such as "at least one of," when preceding a list of elements, modify the entire list of elements and do not modify the individual elements of the list.

Reference will now be made in detail to embodiments, examples of which are illustrated in the accompanying drawings, wherein like reference numerals refer to like elements throughout. In this regard, embodiments may have different forms and should not be construed as being limited to the descriptions set forth herein. Rather, embodiments are provided so that this disclosure will be thorough and complete, and will fully convey the scope of embodiments to those of ordinary skilled in the art. Accordingly, embodiments are merely described below, by referring to the figures, to explain aspects of the present description.

It will be understood that the terms "comprises", "comprising", "includes", and/or "including" when used herein, specify the presence of components or operations, but do not preclude the presence or addition of one or more other components or operations, unless otherwise specified. It will be further understood that some components or some operations may not be included, and additional components or operations may be further included.

Also, although the terms, 'first', 'second', 'third', etc., may be used herein to describe various components, these elements or components should not be limited by these terms. These terms are only used to distinguish one element or component from another element or component.

Embodiments, to be described hereinafter, include a method of controlling an image forming apparatus connected to an external device via an external device interface and an image forming apparatus using the same. In the description of embodiments, certain detailed explanations of related art are omitted when it is deemed that they may unnecessarily obscure embodiments.

FIG. 1 is a diagram illustrating a connection of an image processing apparatus 100 to an external device 200. The image forming apparatus 100 may be a printer, a copy machine, or a multifunctional printer. The external device 200 is a device that is connected to the image forming apparatus 100 and requests the image forming apparatus 100 to operate. The external device 200 may be a PC such as a desktop computer or a laptop computer.

Referring to FIG. 1, the image forming apparatus 100 and the external device 200 may be connected to each other via an interface apparatus through wire. If the image forming apparatus 100 and the external device 200, connected to each other via the interface apparatus, are respectively turned on, a user may request the image forming apparatus to operate, by using the external device 200. For example, if a user has a document to be printed, the user may execute a document editing program on the external device 200 such as a PC, and then, open the document to be printed and request the image forming apparatus 100 that is connected to the external device 200 to perform a printing operation, through a printing menu.

When the image forming apparatus 100 and the external device 200 are respectively turned on and normally connected to each other via an interface apparatus, if the user requests the image forming apparatus 100 to perform the printing operation by using the external device 200, the external device 200 may generate and spool a print job and, at the same time, transmit the print job to the image forming apparatus 100. When the print job is transmitted from the external device 200, the image forming apparatus 100 may execute the print job. The image forming apparatus 100 may transmit information regarding the image forming apparatus 100 to the external device 200. Resultantly, the image forming apparatus 100 and the external device 200 may transceive information to/from each other by using an interface apparatus in a bidirectional way.

Various types of interface apparatus may be used as an interface apparatus for connecting the image forming apparatus 100 to the external device 200. For convenience of description, a case when an interface apparatus is a universal serial bus (USB) cable is described as an example with reference to FIG. 2.

Figure 2:
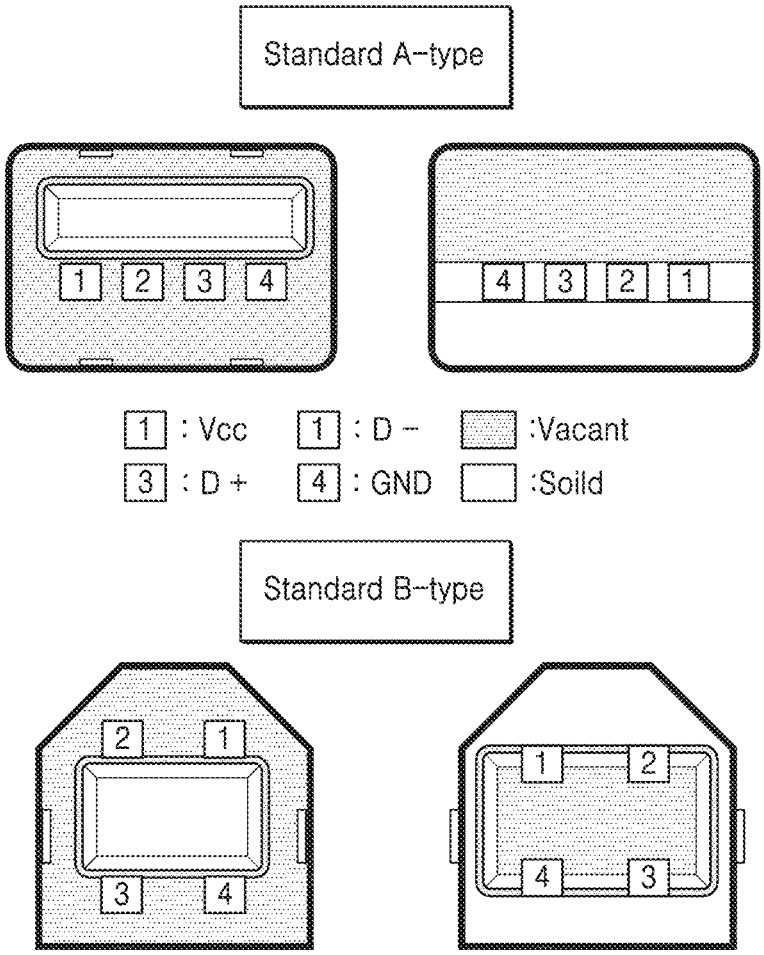
FIG. 2 is a diagram illustrating a universal serial bus (USB) connector part of a USB interface cable and a USB port for connecting the image processing apparatus to the external device.

FIG. 2 is a diagram illustrating a USB connector part of a USB interface cable and a USB port for connecting the image forming apparatus 100 and the external device 200 with each other.

A USB interface may consist of a USB connector formed at an end of the USB interface cable, and the USB connector of the USB interface cable may be inserted into a USB port of a device. Depending on the form of a USB interface or the number of pins included in a USB interface, various types of USB interfaces that consist of a USB connector and a USB port corresponding to the USB connector may be present. For example, the USB interface may be a standard-A type, a standard-B type, a mini-A type, mini-B type, a micro-A type, a micro-B type USB interface, or the like.

Referring to FIG. 2, a standard-A type USB interface and a standard-B type USB interface are shown. The standard-A type USB interface is shown on an upper part of FIG. 2, and the standard-B type USB interface is shown on a lower part of FIG. 2. A USB port is shown on a left part of each type of USB interface in FIG. 2, and a USB connector is shown on a right part of each type of USB interface in FIG. 2.

As shown in FIG. 2, four pins are formed respectively on the USB port and the USB connector in each of the standard-A type USB interface and the standard-B type USB interface. When the USB port and the USB connector are connected to each other, pins of the USB port may respectively contact those of the USB connector. Referring to pins 1 to 4 shown in FIG. 2, the pin 1 is a pin via which power is supplied, the pins 2 and 3 are pins via which data is transmitted, and the pin 4 corresponds to a ground pin.

If the USB connector is connected to the USB port, and power of the external device 200 having the USB port is in an ON state, power may be supplied from the pin 1 of the USB port to the pin 1 of the USB connector. However, power that may be supplied by using such a method has not been used to control an image forming apparatus.

Even though the image forming apparatus 100 is connected to the external device 200 via the USB interface cable as described above with reference to FIG. 1, if power of the image forming apparatus 100 is in an OFF state, the external device 200 may not request the image forming apparatus 100 to perform printing by transmitting information regarding the printing operation to the image forming apparatus 100, and the image forming apparatus 100 may not also transmit information to the external device 200. If a user does not recognize such a state, print jobs may be continuously spooled, the user may wait for printing for a long time, and the image forming apparatus 100 may not execute the print jobs. Thus, printing may not be completed.

For example, if only an alternating current (AC) switch is turned on and a software (SW) power button in the image forming apparatus 100 is not pressed, and thus, the image forming apparatus 100 is not turned on, or if power of the image forming apparatus 100 is automatically turned off after a certain period of time since an automatic power-off function for low-power consumption is performed by the image forming apparatus 100, even if the image forming apparatus 100 and the external device 200 are connected to each other via an interface apparatus such as a USB interface cable, the user may not transmit information regarding the printing operation to the image forming apparatus 100 via the external device 200 or receive information from the image forming apparatus 100. As such, even when power of the image forming apparatus 100 is off, the user does not recognize this and continuously attempts to request the image forming apparatus 100 to perform a printing operation via the external device 200. Accordingly, even though the user waits until the printing operation is completed, even though printing data is only spooled, and this causes inconvenience to the user.

Hereinafter, a method of controlling the image forming apparatus 100 by using power that may be supplied from the external device 200 connected to the image forming apparatus 100 via an interface apparatus, if there is a user request for operation of the image forming apparatus 100 when power of the image forming apparatus 100 is in an OFF state, and the image forming apparatus 100 using the same are described.

As described above with reference to FIG. 2, if the USB connector is connected to the USB port connector and power of the external device 200 having the USB port is in an ON state, the power may be supplied from the pin 1 of the USB port to the pin 1 of the USB connector. In other words, according to a structure of the USB interface, if the USB connector is connected to the USB port and power of the external device 200 having the USB port is in an ON state, the pin 1 of the USB port may supply the power to the pin 1 on the USB connector at one end of the USB interface cable, and thus, the power may be supplied to the image forming apparatus 100 connected to the other end of the USB interface cable.

Figure 3:
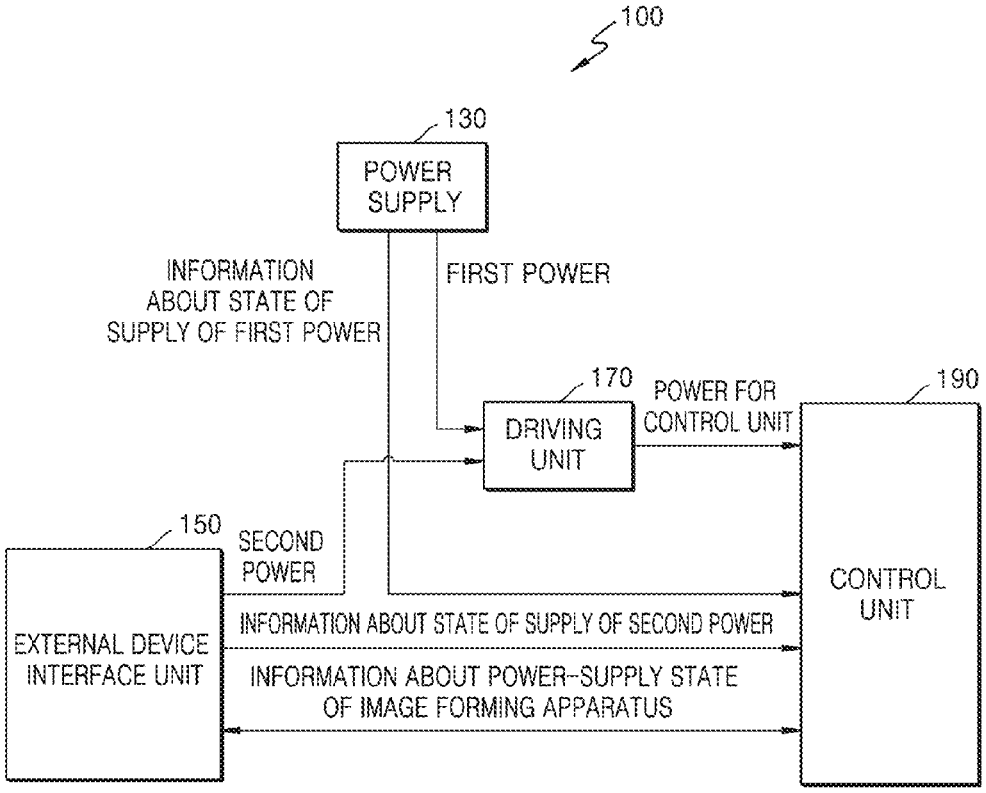
FIG. 3 is a block diagram of a configuration of the image forming apparatus, according to an exemplary embodiment.

FIG. 3 is a block diagram of a configuration of the image forming apparatus 100, according to an exemplary embodiment.

Referring to FIG. 3, the image forming apparatus 100 may include a power supply 130, an external device interface unit (external device interface) 150, a driving unit (driver) 170, and a control unit (controller) 190. It may be understood by one of ordinary skill in the art that, in addition to the components shown in FIG. 3, other general-use components may be further included.

The power supply 130 may generate power used by the image forming apparatus 100. The power supply 130 may convert AC power, input from outside, into direct current (DC) power having such a magnitude that may be used by the image forming apparatus 100 and supply the DC power to each part of the image forming apparatus 100. The power supply 130 may generate and transmit various magnitudes of DC power to each part of the image forming apparatus 100. For example, the power supply 130 may supply power to drive the control unit 190, which is hereinafter referred to as first power.

Even though AC power is input from outside to the power supply 130, if the SW power button is not pressed or a predetermined period of time set by the user elapses after the image forming apparatus 100 enters a power-saving mode, the power supply 130 may obstruct supply of a plurality of pieces of power that include the first power to the image forming apparatus 100.

The external device interface unit 150 may connect the image forming apparatus 100 to the external device 200. The external device interface unit 150 is a unit to which an interface apparatus supporting a connection of the image forming apparatus 100 to the external device 200 is connected. For example, if the interface apparatus is a USB interface cable, the external device interface unit 150 may be a USB interface (USB interface) unit. In detail, the external device interface unit 150 may be a USB port corresponding to a USB connector of the USB interface cable.

The external device interface unit 150 may receive information transmitted from the external device 200 and transmit information to the external device 200. Additionally, the external device interface unit 150 may receive certain power from the external device 200. As such, power supplied from the external device 200 via the external device interface unit 150 is hereinafter referred to as second power and may be used to drive the control unit 190. For example, if the image forming apparatus 100 and the external device 200 are connected to each other via a USB interface cable, power of 5V/0.5A may be supplied from the pin 1 of the USB port of the external device 200 to the external device interface unit 150 included in the image forming apparatus 100.

The driving unit 170 may generate power for the control unit 190, by using the first power supplied from the power supply 130 or the second power supplied from the external device 200 via the external device interface unit 150. For example, if the second power is not supplied from the external device 200, the driving unit 170 may generate power for the control unit 190 for driving the control unit 190 by using the first power supplied from the power supply 130. If the first power is not supplied from the power supply 130, the driving unit 170 may generate power for the control unit 190 for driving the control unit 190 by using the second power supplied from the external device 200. Particularly, if the SW power button is not pressed or if a predetermined period of time set by the user elapses after the image forming apparatus 100 enters a power-saving mode, and thus, the power supply 130 obstructs supply of a plurality of pieces of power including the first power to the image forming apparatus 100, the driving unit 170 may generate power for the control unit 190 by using the second power supplied from the external device 200 via the external device interface unit 150. The power for the control unit 190, which is generated by the driving unit 170, may be transmitted to the control unit 190, thus driving the control unit 190.

Figure 4:
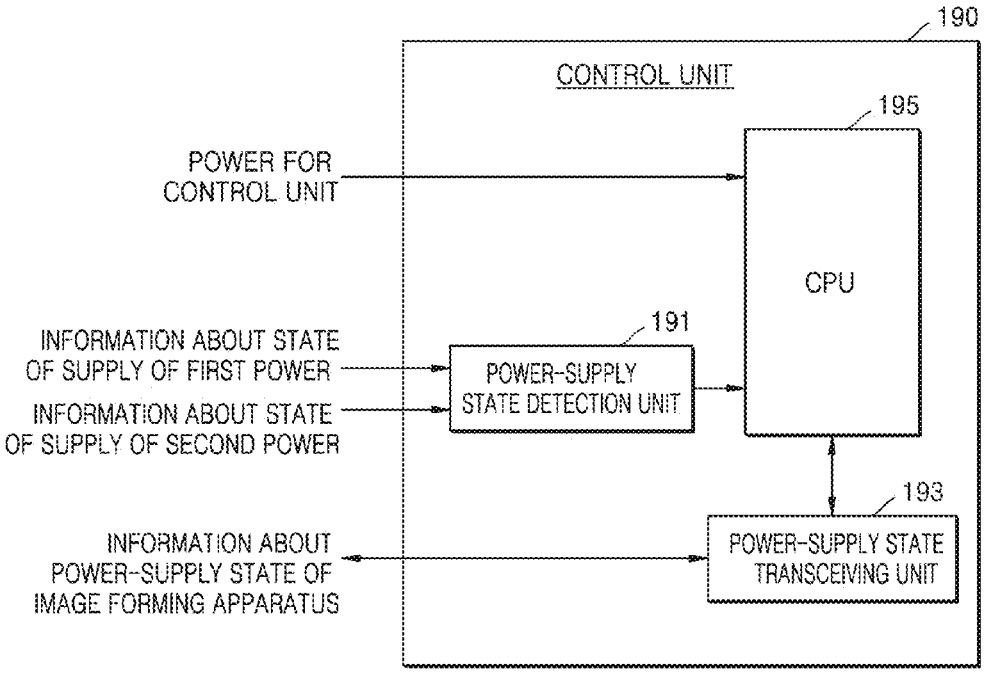
FIG. 4 is a block diagram of a control unit included in the image forming apparatus, according to an exemplary embodiment in detail.

The control unit 190 is driven by the power for the control unit 190, which is generated by the driving unit 170, and thus, may control all operations of the image forming apparatus 100. The control unit 190 may generate information about a power supply state of the image forming apparatus 100, based on whether or not the first power is supplied from the power supply 130 and whether or not the second power is supplied from the external device 200 via the external device interface unit 150. For this, the control unit 190 may receive information about a state of supply of the first power from the power supply 130, and information about a state of supply of the second power from the external device interface unit 150. Additionally, the control unit 190 may receive a request for information about a power supply state of the power supply 130 and transmit the information about the power supply state of the image forming apparatus 100, which is generated by the control unit 190. Referring to FIG. 4, the control unit 190 is described in detail.

FIG. 4 is a block diagram of the control unit 190 included in the image forming apparatus 100 in detail, according to an exemplary embodiment.

The control unit 190 may include a power-supply state detection unit (power-supply state detector) 191, a power-supply state transceiving unit (power-supply state transceiver) 193, and a central processing unit (CPU) 195. It may be understood by one of ordinary skill in the art that, in addition to the components shown in FIG. 4, other general-use components may be further included.

The power-supply state detection unit 191 may generate information about a power-supply state of the image forming apparatus 100 by receiving information about a state of supply of the first power from the power supply 130 and receiving information about a state of supply of the second power from the external device interface unit 150. The information about the power-supply state of the image forming apparatus 100 may be transmitted to the CPU 195.

The power-supply state transceiving unit 193 may receive a request for information about a power-supply state of the image forming apparatus 100 from the external device 200. Additionally, the power-supply state transceiving unit 193 may transmit information about a power-supply state of the image forming apparatus 100, transmitted from the control unit 190, to the external device 200.

The CPU 195 is driven by power for the control unit 190, and may be connected to the power-supply state detection unit 191 and the power-supply state transceiving unit 193. The CPU 195 may include a register (not illustrated) for storing information about a power-supply state of the image forming apparatus 100, which is generated by the power-supply state detection unit 191.

The CPU 195 may monitor the information about the power-supply state of the image forming apparatus 100, which is generated by the power-supply state detection unit 191. For example, if the image forming apparatus 100 needs to be controlled, such as a case when the CPU 195 receives a request for operation of the image forming apparatus 100 or a request for the information about the power-supply state of the image forming apparatus 100 from the external device 200, or a case when user manipulation is input to a user interface unit (not illustrated), the CPU 195 may monitor the information about the power-supply state of the image forming apparatus 100.

According to a result of the monitoring of the information about the power-supply state of the image forming apparatus 100, the CPU 195 may control the image forming apparatus 100. For example, if the information about the power-supply state of the image forming apparatus 100 indicates that supply of the first power is obstructed, the CPU 195 may control the power supply 130 to resume the supply of the first power or supply a plurality of pieces of power that include the first power to the image formation apparatus 100.

When the request for the information about the power-supply state of the image forming apparatus 100 is received from the external device 200 by the power-supply state transceiving unit 193, in response to this, the CPU 195 may check the register for storing the information about the power-supply state which is generated by the power-supply state detection unit 191, and transceive the information about the power-supply state of the image forming apparatus 100 to the external device 200 via the power-supply state transceiving unit 193.

FIG. 5 is a diagram for explaining an output from the driving unit 170 and the power-supply state detection unit 191 according to whether or not first power is supplied or whether or not second power is supplied.

FIG. 5 shows information about power for the control unit 190 and a power-supply state of the image forming apparatus 100, with respect to the first power supplied from the power supply 130 and the second power supplied from the external device 200 via the external device interface unit 150. In FIG. 5, a case when power is supplied is referred to as H, and a case when power is not supplied is referred to as L.

If the information about the power for the control unit 190 is shown as H, this indicates that the power for the control unit 190 is output from the driving unit 170. If the information about the power for the control unit 190 is shown as L, this indicates that the power for the control unit 190 is not output from the driving unit 170. The power for the control unit 190 is normally output when at least one selected from the group consisting of the first power and the second power is supplied to the control unit 190, and is not output when neither the first power nor the second power is supplied to the control unit 190. Since the control unit 190 may not be driven when the power for the control unit 190 is not output, the control unit 190 may control the image forming apparatus 100 when at least one selected from the group consisting of the first power and the second power is supplied, and thus, the power for the control unit 190 is normally output.

The information about the power-supply state of the image forming apparatus 100 may be H only when the first power is obstructed. However, since at least one selected from the group consisting of the first power and the second power needs to be supplied to drive the control unit 190, if the control unit 190 monitors that the first power is obstructed, it may be understood that the second power is supplied from the external device 200. If the second power is supplied but the first power is obstructed, for example, if a user requests the image forming apparatus 100 to operate when the power of the image forming apparatus 100 is in an OFF state and the image forming apparatus 100 is connected to the external device 200, the control unit 190 is driven by using the second power to appropriately control the image forming apparatus 100 upon the user's request. A case when the first power is obstructed and only the second power is supplied, and thus, the control unit 190 is driven by using the second power to control the image forming apparatus 100 will be described later with reference to FIGS. 7 through 9.

Figure 6:
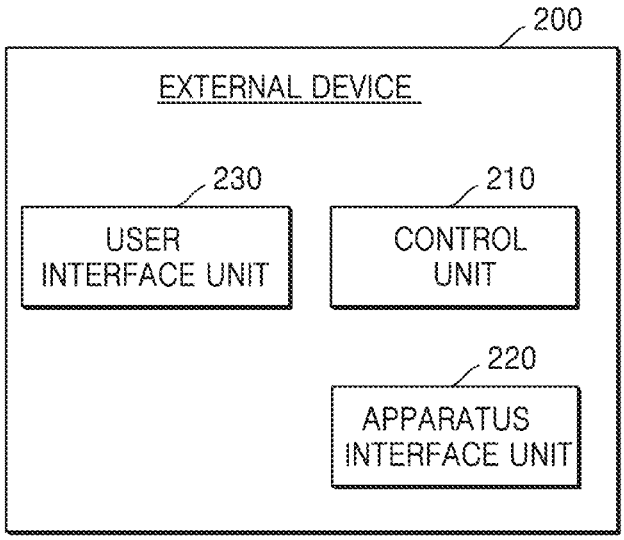
FIG. 6 is a block diagram of a configuration of the external device, according to an exemplary embodiment.

FIG. 6 is a block diagram of a configuration of the external device 200, according to an exemplary embodiment.

The external device 200 may be an electronic device that may be connected to the image forming apparatus 100 via an interface apparatus. The external device 200 may be a PC in the form of a desktop computer or a laptop computer. The user may operate the image forming apparatus 100 to perform a printing job by using the external device 200.

The external device 200 may include a control unit 210, an apparatus interface unit 220, and a user interface unit (user interface) 230. It may be understood by one of ordinary skill in the art that, in addition to the components shown in FIG. 6, other general-use components may be further included.

The control unit 210 may control all operations of the image forming apparatus 100. The control unit 210 may transceive information with an apparatus connected to the external device 200 via the apparatus interface unit 220. The external device 200 may receive user manipulation via the user interface unit 230 and display a screen related to operation of the external device 200 to the user.

The apparatus interface unit 220 may connect the external device 200 to another apparatus. For example, the apparatus interface unit 220 may connect the external device 200 to the image forming apparatus 100. The apparatus interface unit 220 may be a unit to which an interface apparatus supporting a connection of the external device 200 to the image forming apparatus 100 is connected. For example, if the interface apparatus is a USB interface cable, the apparatus interface unit 220 may be a USB interface unit. In detail, the apparatus interface unit 220 may be a USB port corresponding to a USB connector of the USB interface cable.

The apparatus interface unit 220 may transmit information to the image forming apparatus 100 and receive information transmitted from the image forming apparatus 100. For example, the external device 200 may transmit a request for information about a power-supply state of the image forming apparatus 100 via the apparatus interface unit 220 and receive information about a power-supply state of the image forming apparatus 100 from the image forming apparatus 100. Additionally, if there is a user request for printing, the apparatus interface unit 220 may transmit a print job, generated by the external device 200, to the image forming apparatus 100 via the apparatus interface unit 220.

Additionally, the apparatus interface unit 220 may supply a predetermined power generated by the external device 200 to the image forming apparatus 100. In detail, power generated by the external device 200 is transmitted to the image forming apparatus 100 via the apparatus interface unit 220, and power transmitted via an interface apparatus may be supplied to the image forming apparatus 100 via the external device interface unit 150 included in the image forming apparatus 100. The second power supplied from the external device 200 via the external device interface unit 150, described above, may be power supplied from the external device 200 to the image forming apparatus 100 by using such a method. For example, a USB port of the external device 200 may correspond to the apparatus interface unit 220, and power of 5V/0.5A may be supplied from the pin 1 on the USB port of the external device 200 to the external device interface unit 150 included in the image forming apparatus 100.

The user interface unit 230 may display a screen for receiving a user manipulation input of or providing information to the user. For example, the user may execute a document-editing program to request a document to be printed, via the user interface unit 230. Additionally, if information about the image forming apparatus 100 is transmitted from the image forming apparatus 100, the user interface unit 230 may display the information. For example, if the apparatus interface unit 220 receives information about a power-supply state of the image forming apparatus 100 from the image forming apparatus 100, the control unit 210 may control the user interface unit 230 to display the received information about the power-supply state of the image forming apparatus 100 on the screen to provide the information to a user. If the image forming apparatus 100 is turned off, the user interface unit 230 may display information, which indicates that supply of the first power to the image forming apparatus 100 is obstructed, on the screen so as to provide the information to a user. Additionally, a message requesting supply of the first power to the image forming apparatus 100 to resume or a message notifying that supply of the first power to the image forming apparatus 100 is automatically resumed may be displayed together with the information about the power-supply state of the image forming apparatus 100.

Hereinafter, various embodiments are described with reference to FIGS. 7 and 8, wherein, if supply of the first power to the image forming apparatus 100 is obstructed and only the second power is supplied from the external device 200 to the image forming apparatus 100, the image forming apparatus 100 is controlled by driving the control unit 190 included in the image forming apparatus 100 by using the second power.

Figure 7:
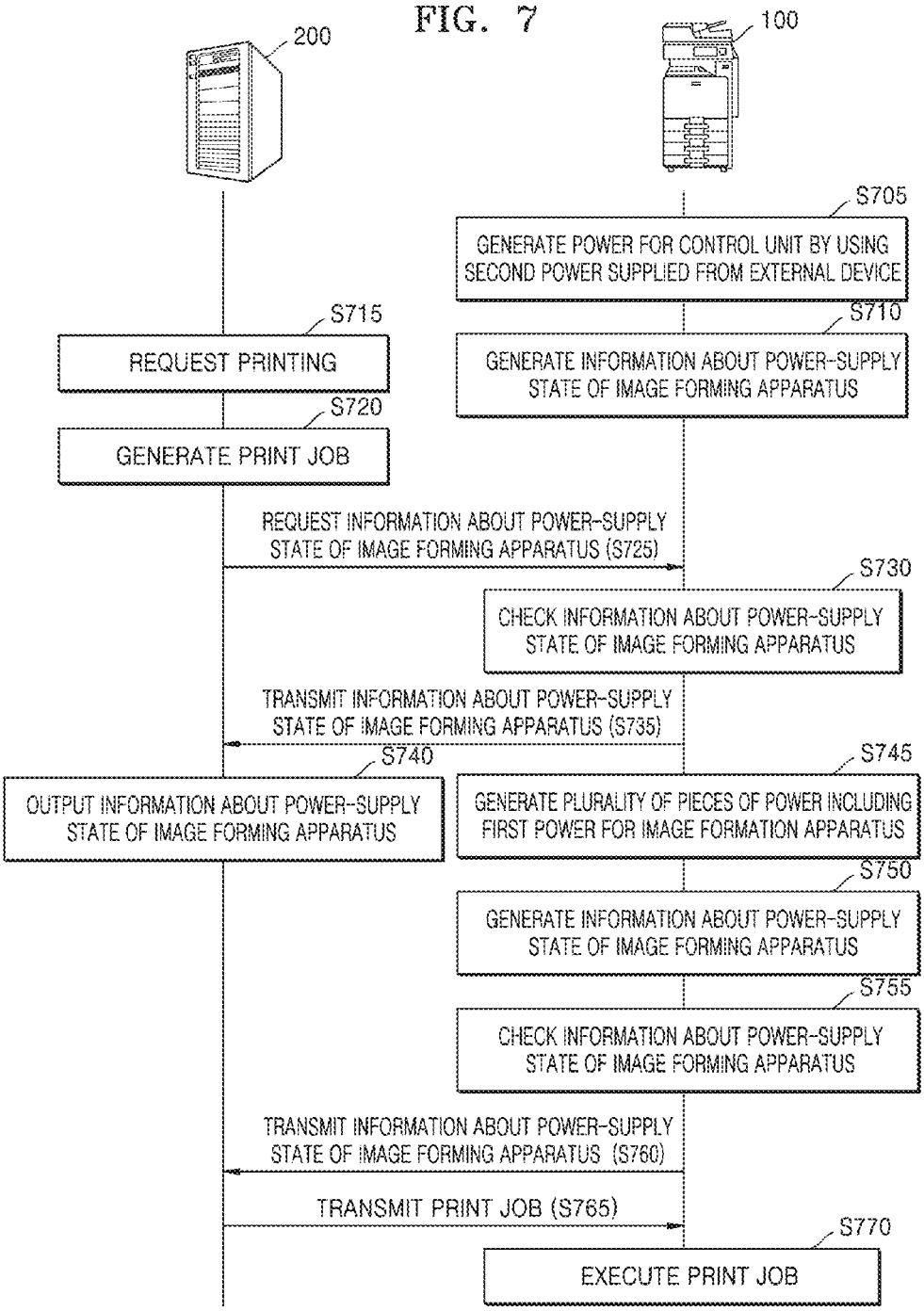
FIGS. 7 and 8 are diagrams for explaining operation of the image forming apparatus, if a request for a printing operation is generated from the external device connected to the image forming apparatus when supply of the first power to the image forming apparatus is obstructed.
Figure 8:
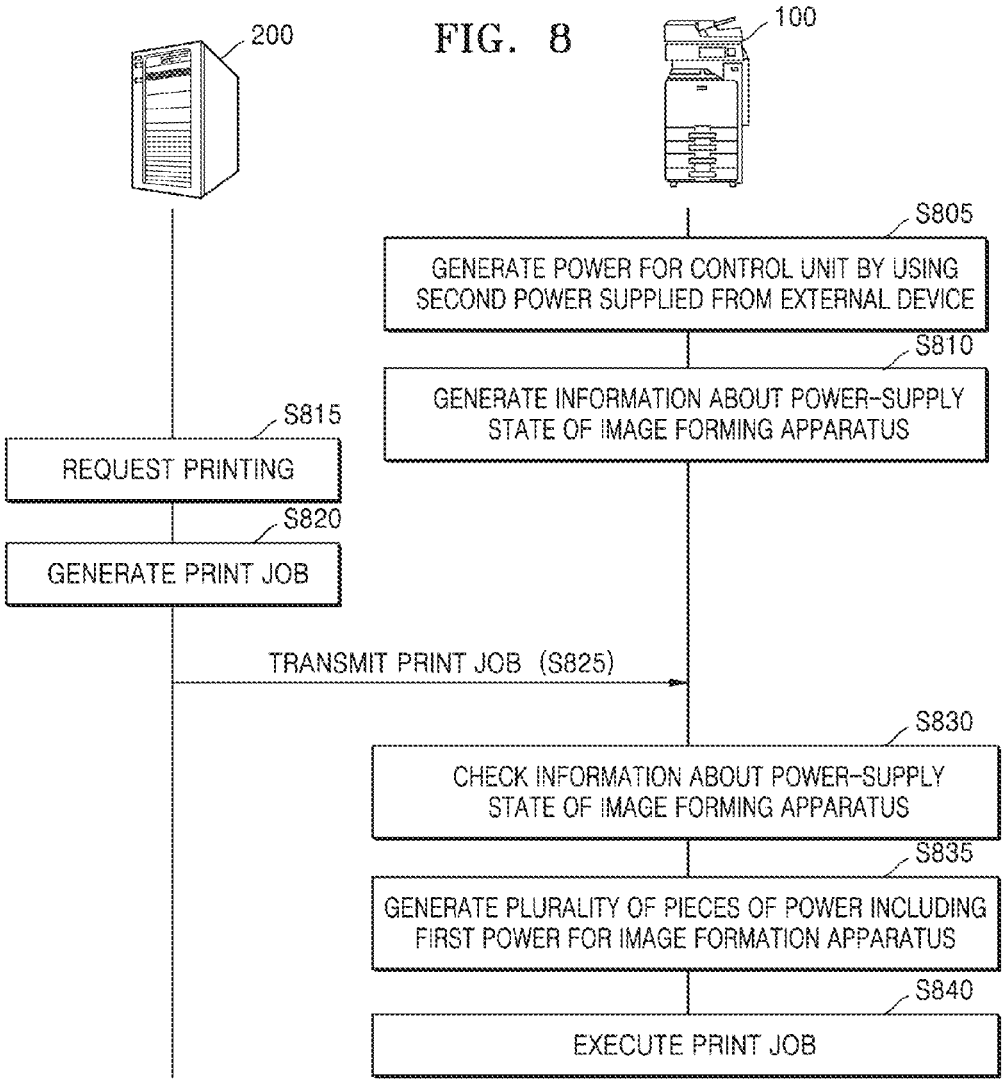

FIGS. 7 and 8 are diagrams for explaining operation of the image forming apparatus 100, if a request for printing work is generated from the external device 200 connected to the image forming apparatus 100 when supply of the first power to the image forming apparatus is stopped.

Referring to FIG. 7, if a request for performing a printing operation is generated from the external device 200 connected to the image forming apparatus 100, according to the request from the external device 200, the image forming apparatus 100 notifies the external device 200 that supply of the first power is stopped and, after the supply of the first power to the image forming apparatus 100 is resumed, receives information about the printing operation from the external device 200 and performs the printing operation.

If supply of the first power generated by the image forming apparatus 100 is obstructed, the image forming apparatus 100 may generate power for the control unit 190 by using the second power supplied from the external device 200 in operation S705. The control unit 190 included in the image forming apparatus 100 may be driven by the power for the control unit 190, which is generated by using such a method.

The image forming apparatus 100 may generate information about a power-supply state of the image forming apparatus 100 in operation S710. In other words, the control unit 190 included in the image forming apparatus 100 is driven by the power for the control unit 190 which is generated by using the second power, and may generate information about a power-supply state of the image forming apparatus 100 based on whether or not first power or the second power is supplied.

In operation S715, a user may request the image forming apparatus 100 to perform the printing job via the external device 200 connected to the image forming apparatus 100.

In operation S720, the external device 200 may generate a print job to be transmitted to the image forming apparatus 100. The external device 200 may spool the generated print job.

In operation S725, the external device 200 may request the image forming apparatus 100 for information about a power-supply state of the image forming apparatus 100, before transmitting the print job to the image forming apparatus 100.

In operation S730, according to the request by the external device 200, the image forming apparatus 100 may check information about a power-supply state of the image forming apparatus 100, which is generated by the image forming apparatus 100.

In operation S735, the image forming apparatus 100 may transmit the checked information about the power-supply state of the image forming apparatus 100 to the external device 200.

In operation S740, the external device 200 may output the information about the power-supply state of the image forming apparatus 100, which is transmitted from the image forming apparatus 100. For example, the external device 200 may display a message, which indicates that the supply of the first power to the image forming apparatus 100 is stopped, on the user interface unit 230 included in the external device 200.

In operation S745, the image forming apparatus 100 may resume supplying power to the image forming apparatus 100 by generating the first power or a plurality of pieces of power that include the first power for the image formation apparatus 100. For example, if the user of the external device 200 checks that supply of the first power is obstructed, the user may operate the power supply 130 included in the image forming apparatus 100 to resume supplying power. Alternatively, the control unit 190 included in the image forming apparatus 100 may automatically resume supplying power to the image forming apparatus 100 by controlling the power supply 130 included in the image forming apparatus 100.

In operation S750, the image forming apparatus 100 may regenerate information about a power-supply state of the image forming apparatus 100. In other words, the control unit 190 included in the image forming apparatus 100 may update information about a power-supply state of the image forming apparatus 100, based on whether or not the first power or the second power is supplied.

In operation S755, the image forming apparatus 100 may check the information about the power-supply state of the image forming apparatus 100.

In operation S760, the image forming apparatus 100 may transmit the checked information about the power-supply state of the image forming apparatus 100 to the external device 200. The transmitted information about the power-supply state of the image forming apparatus 100 may indicate that the first power is normally supplied to the image forming apparatus 100.

After the external device 200 checks that the first power is normally supplied to the image forming apparatus 100, the external device 200 may transmit the print job, generated according to the request by the user, to the image forming apparatus 100 in operation 765.

In operation S770, the image forming apparatus 100 may execute the print job transmitted from the external device 200.

Referring to FIG. 8, if a request for performing a printing operation is generated from the external device 200 connected to the image forming apparatus 100, when information about the printing operation is transmitted from the external device 200, the image forming apparatus 100 checks that supply of first power is stopped, automatically resumes the supply of the first power, and then, performs the printing operation.

If supply of the first power generated by the image forming apparatus 100 is obstructed, the image forming apparatus 100 may generate power for the control unit 190 by using the second power supplied from the external device 200 in operation S805. The control unit 190 included in the image forming apparatus 100 may be driven by the power for the control unit 190 which is generated by using the second power.

In operation S810, the image forming apparatus 100 may generate information about a power-supply state of the image forming apparatus 100. In other words, the control unit 190 included in the image forming apparatus 100 is driven by the power for the control unit 190 which is generated by using the second power and may generate information about a power-supply state of the image forming apparatus 100 based on whether or not the first power or the second power is supplied.

In operation S815, a user may request the image forming apparatus 100 to perform the printing operation via the external device 200 connected to the image forming apparatus 100.

In operation S820, the external device 200 may generate a print job to be transmitted to the image forming apparatus 100. The external device 200 may spool the generated print job.

In operation S825, the external device 200 may transmit the print job, generated according to the request by the user, to the image forming apparatus 100.

In operation S830, after the print job is transmitted from the external device 200, the image forming apparatus 100 may check information about a power-supply state of the image forming apparatus 100, which is generated by the image forming apparatus 100.

If the checked information about the power-supply state of the image forming apparatus 100 indicates that supply of the first power is obstructed, the image forming apparatus 100 may generate the first power or a plurality of pieces of power that include the first power for the image formation apparatus 100 so as to resume supplying the power to the image forming apparatus 100 in operation S835. For example, the control unit 190 included in the image forming apparatus 100 may automatically resume supplying power by controlling the power supply 130 included in the image forming apparatus 100. Then, the image forming apparatus 100 may generate information about a power-supply state of the image forming apparatus 100 based on whether or not first power or the second power is supplied.

After checking that the first power is normally supplied to the image forming apparatus 100, the image forming apparatus 100 may perform the print job transmitted from the external device 200, in operation 840.

Figure 9:
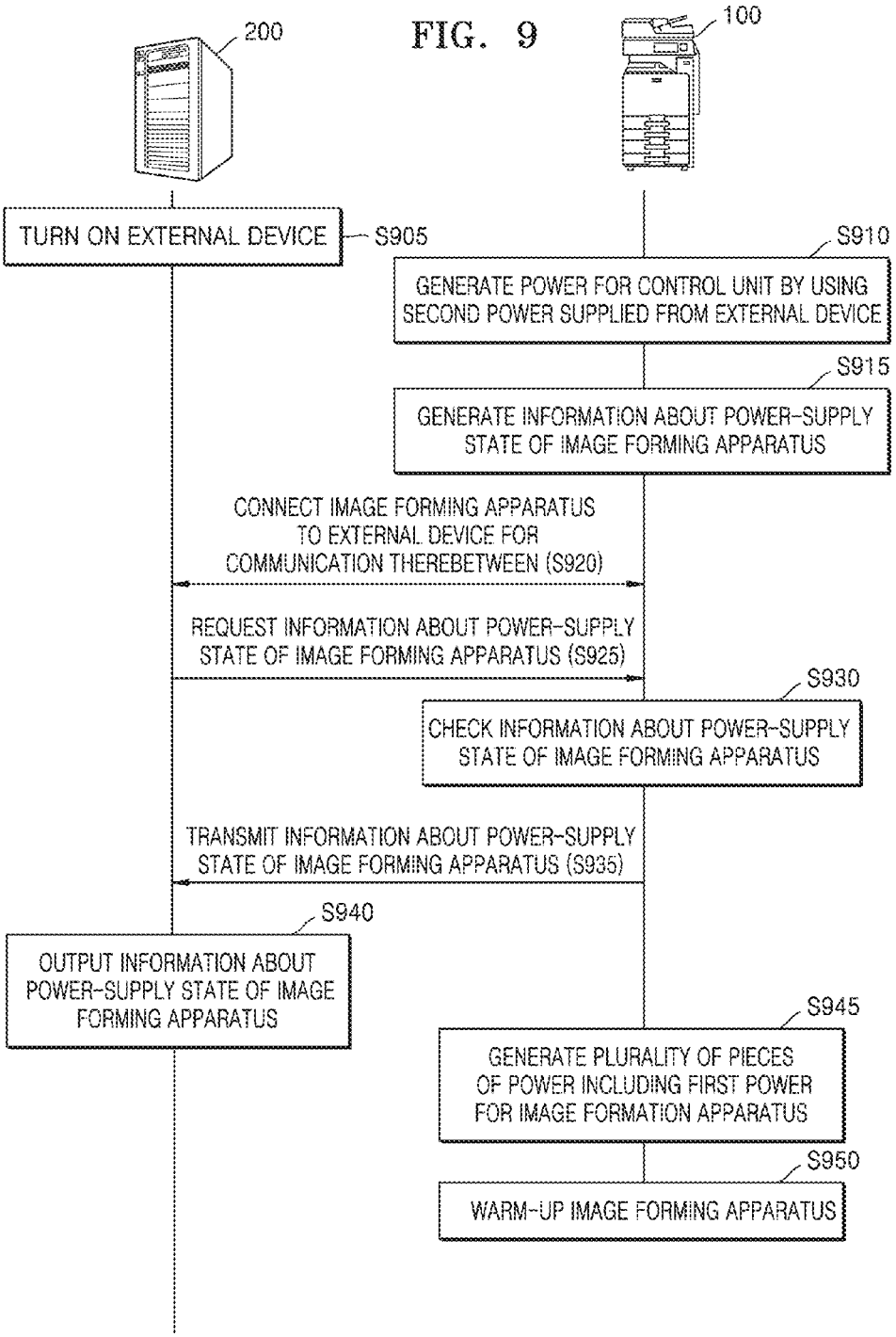
FIG. 9 is a diagram for explaining operation of the image forming apparatus, if the external device connected to the image forming apparatus is turned on when power is not supplied to the image forming apparatus and the external device.

FIG. 9 is a diagram for explaining operation of the image forming apparatus 100, if power of the external device 200 connected to the image forming apparatus 100 is in an ON state when power is not supplied to the image forming apparatus 100 and the external device 200. In detail, FIG. 9 shows operation of the image forming apparatus 100 and the external device 200, if the external device 200 is turned on when the image forming apparatus 100 and the external device 200 are connected to each other via an interface apparatus but both the image forming apparatus 100 and the external device are in an OFF state.

In operation S905, only the external device 200 may be turned on when the image forming apparatus 100 and the external device 200 are connected to each other via the interface apparatus.

In operation S910, the image forming apparatus 100 may generate power for the control unit 190 by using the second power supplied from the external device 200 via the external device interface unit 150. The control unit 190 included in the image forming apparatus 100 may be driven by the power for the control unit 190, which is generated by using the second power. In this case, booting of the image forming apparatus 100 may be performed, other than warming-up of the image forming apparatus 100, which is performed by raising a temperature of a fixing apparatus or driving a motor for printing.

In operation S915, the image forming apparatus 100 may generate information about a power-supply state of the image forming apparatus 100. In other words, the control unit 190 included in the image forming apparatus 100 may generate information about a power-supply state of the image forming apparatus 100, based on whether or not the first power or the second power is supplied.

In operation S920, the control unit 190 included in the image forming apparatus 100 may connect the image forming apparatus 100 to the external device 200 so that the image forming apparatus 100 may communicate with the external device 200. Accordingly, the control unit 290 included in the image forming apparatus 100 may perform a bidirectional communication for transceiving information with the external device 200 via the external device interface unit 150.

In operation 925, the external device 200 may request information about a power-supply state of the image forming apparatus 100.

In operation S930, according to the request by the external device 200, the image forming apparatus 100 may check information about the power-supply state of the image forming apparatus 100, which is generated by the image forming apparatus 100.

In operation S935, the image forming apparatus 100 may transmit the checked information about the power-supply state of the image forming apparatus 100 to the external device 200.

In operation S940, the external device 200 may output the information about the power-supply state of the image forming apparatus 100, which is transmitted from the image forming apparatus 100. For example, the external device 200 may display a message, which indicates that supply of the first power to the image forming apparatus 100 is obstructed, on the user interface unit 230 included in the external device 200.

In operation S945, the image forming apparatus 100 may resume supplying power to the image formation apparatus 100 by generating the first power or a plurality of pieces of power that include the first power. For example, if a user of the external device 200 checks that supply of the first power is obstructed, the user may operate the power supply 130 included in the image forming apparatus 100 so as to resume supplying power to the image forming apparatus 100. Alternatively, the control unit 190 included in the image forming apparatus 100 may automatically resume supplying power to the image forming apparatus 100 by controlling the power supply 130 included in the image forming apparatus 100.

The control unit 190 included in the image forming apparatus 100 may warm-up the image forming apparatus 100. In other words, after a plurality of pieces of power are supplied from the power supply 130 to the image forming apparatus 100, the control unit 190 included in the image forming apparatus 100 may control the warming-up of the image forming apparatus 100 for printing by raising a temperature of a fixing apparatus or driving a motor.

Figure 10:
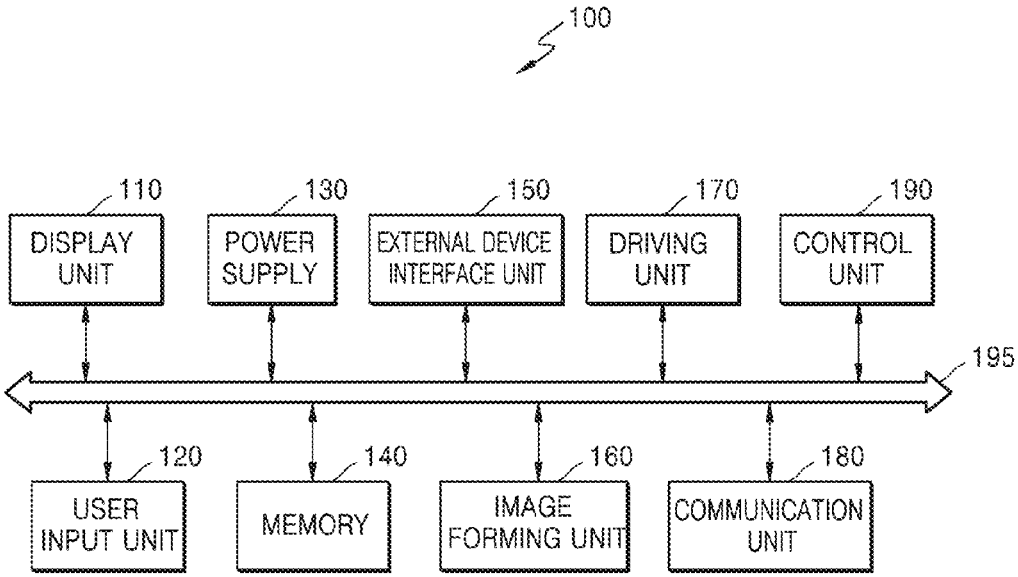
FIG. 10 is a block diagram of a configuration of the image forming apparatus according to an exemplary embodiment.

FIG. 10 is a block diagram of a configuration of the image forming apparatus 100 according to another exemplar embodiment. It may be understood by one of ordinary skill in the art that, in addition to the components shown in FIG. 10, other general-use components may be further included.

Referring to FIG. 10, the image forming apparatus 100 may include a display unit 110, a user input unit 120, the power supply 130, a memory 140, the external device interface unit 150, an image forming unit 160, the driving unit 170, a communication unit 180, and the control unit 190. Such components may transceive various data with each other, by using a data bus 195. The descriptions of components, which were already provided above, are not provided here again.

The display unit 110 may include a display panel (not illustrated) and a controller (not illustrated) for controlling the display panel. The display panel may be implemented by using various forms of displays such as a liquid crystal display (LCD), an organic light-emitting diode (OLED) display, an active-matrix organic light-emitting diode (AMOLED) display, or plasma display panel (PDP) display. The display unit 110 may be combined with a touch panel (not illustrated) of the user input unit 120 to constitute a touchscreen (not illustrated). For example, the touchscreen (not illustrated) may include a module that is formed as one body in which the display panel and the touch panel form a layered structure.

The user input unit 120 may receive a user input of various commands. The user input unit 120 may include at least one selected from the group consisting of a touch panel, a pen-recognition panel, and a key.

The touch panel may detect a touch input by the user and output a touch event value corresponding to the detected touch input. If the touch panel and the display panel are combined with each other to constitute a touchscreen, the touchscreen may be implemented by using various types of touch sensors such as a capacitive touchscreen or a resistive touchscreen. The capacitive touchscreen is formed by using a method of detecting micro-electricity generated from a body of a user when a part of the body of the user touches a surface of the touchscreen and calculating a coordinate of the touched location, by using a dielectric material coated on a surface of the touchscreen. The resistive touchscreen is formed by using a method of detecting current flowing when, if a user touches a touchscreen that includes two built-in electrode plates, an upper electrode plate and a lower electrode plate between the two built-in electrode plates contact each other at a touched location of the touchscreen, and calculating a coordinate of the touched location of the touchscreen. A touch event that occurs on the touchscreen may be generated mainly by a finger of a person, but may also be generated by a conductive material that may change electrostatic capacity.

A pen recognition panel may detect a proximity input or a touch input of a touch pen used by a user, for example, a stylus pen or a digitizer pen, and output an event of the detected pen proximity input or an event of the detected pen touch input. The pen recognition panel may detect a touch input or a proximity input according to a change in strength of an electromagnetic field as the touch pen is near or touches the pen recognition panel.

The key may be various types of keys, such as a mechanical button or a wheel, which is formed on various areas such as at a front or a side of a main body of the image forming apparatus 100 or in a periphery of the display unit 110.

The power supply 130 is an apparatus for outputting an AC voltage, supplied from an external power source, into a DC voltage appropriate for an electronic product by using a transformer. The image forming apparatus 100 needs a power supply that has a small and simple structure but may provide stable power supply. For example, a switching-mode power supply (SMPS) may be employed as the power supply. A voltage generated by the power supply 130 may be a DC voltage such as 3.3 V, 5 V, or 24 V, but is not limited thereto.

The memory 140 may store all programs and data which are generated according to operation of the image forming apparatus 100 or used when the image forming apparatus 100 operates. For example, the memory 140 may store data received from an external apparatus, data input via the user input unit 120, data generated according to operation of the image forming apparatus 100, such as faxing data, scanning data, or copying data, or various programs for controlling the image forming apparatus 100. Additionally, the memory 140 may temporarily or semi-permanently store at least a part of content to be displayed on a screen of the display unit 110.

The memory 140 may include at least one selected from the group consisting of an internal memory (not illustrated) and an external memory (not illustrated). For example, the internal memory may include at least one selected from the group consisting of a volatile memory, for example, dynamic random access memory (DRAM), static random access memory (SRAM), or synchronous DRAM (SDRAM), a non-volatile memory, for example, one-time programmable read-only memory (OTPROM), programmable read-only memory (PROM), erasable and programmable read-only memory (EPROM), electrically erasable and programmable read-only memory (EEPROM), mask read-only memory (ROM), or flash ROM, a hard-disk drive (HDD), and a solid-state drive (SSD). The external memory may include at least one selected from the group consisting of compact flash (CF), secure digital (SD), micro-SD, Mini-SD, extreme digital (xD), and a memory stick.

The external device interface unit 150 may function as an interface with the external device 200 connected to the image forming apparatus 100. The external device interface unit 150 may be a USB interface unit or a high-definition multimedia interface (HDMI) interface unit for connecting to the external device 200 such as a PC or a smart TV. The external device interface unit 150 may transceive data with the external device 200 and receive certain power from the external device 200.

The image forming unit 160 outputs copying data or printing data to a printing medium such as printing paper by forming an image of the copying data or the printing data. The image forming unit 160 may include hardware units for performing electrification, exposure, development, transferring, and fixing to output the copying data or printing data to the printing medium, and software modules for driving the hardware units.

The driving unit 170 may generate power for the control unit 190, by using first power supplied from the power supply 130 and second power supplied from the external device 200 via the external device interface unit 150. For example, if the second power is not supplied, the driving unit 170 may generate power for the control unit 190 for driving the control unit 190 by using the first power. If the first power is not supplied, the driving unit 170 may generate the power for the control unit 190 for driving the control unit 190 by using the second power. The power for the control unit 190, which is generated by the driving unit 170, may be supplied to the control unit 190, and thus, drive the control unit 190.

The communication unit 180 may include a network module for connecting to a network and a modem used for fax transmission/reception, according to an application and a function of the image forming apparatus 100. The communication unit 180 may perform data communication with various types of external devices 200 according to various types of communication methods. The communication unit 180 may include at least one selected from the group consisting of a WiFi chip, a Bluetooth chip, a wireless communication chip, and a near-field communication (NFC) chip.

The WiFi chip and the Bluetooth chip may perform communication respectively by using a WiFi method and a Bluetooth method. If the WiFi chip or the Bluetooth chip is used, various connection information such as a service set identifier (SSID) or a session key is transceived, and thus, the communication unit 180 connects the image forming apparatus 100 to the external device 200 so that the image forming apparatus 100 may communicate with the external device 200 and various information may be transceived between the image forming apparatus 100 and the external device 200. The wireless communication chip is a chip for performing communication according to various communication standards such as IEEE, ZigBee, third generation (3G), third generation partnership project (3GPP), or long-term evolution (LTE). The NFC chip is a chip operated by using a NFC method that employs a bandwidth of 13.56 MHz selected from among various radio-frequency identification (RFID) frequency bandwidths such as 135 kHz, 13.56 MHz, 433 MHz, 860 through 960 MHz, 2.45 GHz.

The control unit 190 controls all operations of the image forming apparatus 100, and may be in the form of a microprocessor. The control unit 190 may be divided into a plurality of processor modules that are separated according to each function, and a main processor module that comprehensively manages the plurality of processor modules. The control unit 190 may control the display unit 110 and the user input unit 120 to display a screen that includes a user interface so that a user may view the screen, and process a screen, corresponding to user manipulation input, to be displayed. Additionally, the control unit 190 may control the memory 140 to store various programs or data, or to load various programs or data stored in the memory 140. The control unit 190 may control the data, stored in the memory 140, to be transmitted to the image forming unit 160. Additionally, the control unit 190 may perform data communication with the external device 200 via the communication unit 180.

The image forming apparatus 100 may further include a faxing unit (not illustrated) and/or a scanning unit (not illustrated) according a type.

The faxing unit (not illustrated) transmits or receives fax data by using a modem. The faxing unit (not illustrated) may convert image data written to a document into faxing data to be appropriate for fax transmission performed by using a modem, or process faxing data received from an external apparatus to be transmitted to the image forming unit 160 and output to a printing medium such as printing paper.

The scanning unit (not illustrated) scans image data written to a document, and thus, generates scanning data. Then, the scanning unit (not illustrated) transmits the scanning data to the communication unit 180 so as to connect to a network, to the memory 140 for storing the scanning data, to the faxing unit (not illustrated) for fax transmission, or to the image forming unit 170 for printing. In other words, the scanning unit (not illustrated) may perform such functions as scan-to-server message block (SMB), scan-to-file transfer protocol (FTP), scan-to-web-distributed authoring and versioning (WeBDAV), scan-to-e-mail, scan-to-PC, or scan-to-box.

The components of the image forming apparatus 100, described above, may have different names. Additionally, according to an exemplary embodiment, the image forming apparatus 100 may be configured to have at least one of the above-described components. Some of the above-described components may not be provided here, or additional components may be further included.

Figure 11:
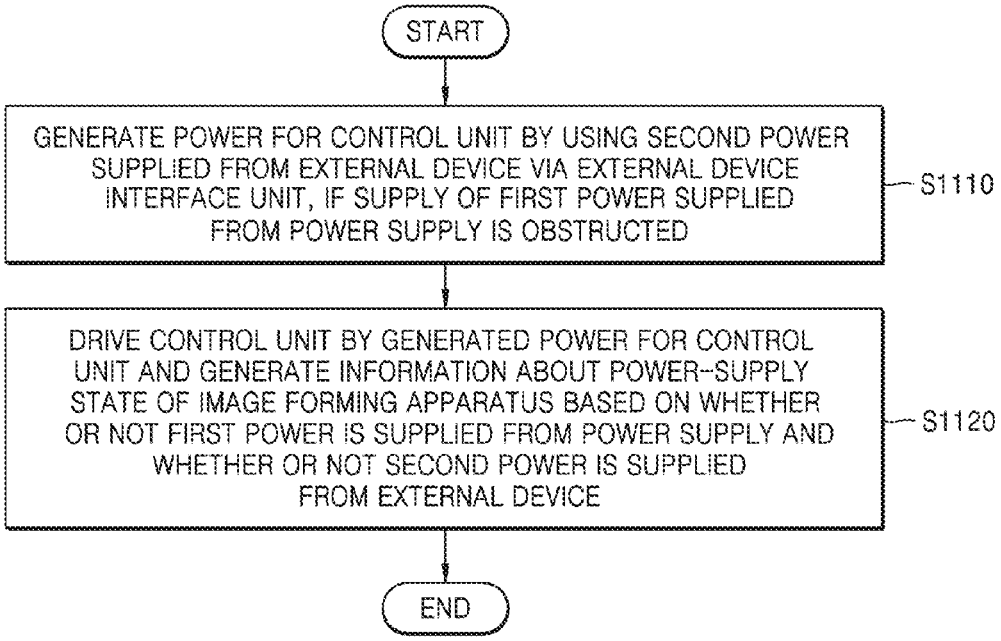
FIG. 11 is a flowchart of a method of controlling the image forming apparatus connected to the external device via an external device interface unit, according to an exemplary embodiment.

FIG. 11 is a flowchart of a method of controlling the image forming apparatus 100 connected to the external device 200 via the external device interface unit 150, according to another exemplary embodiment. The descriptions provided above may be applied to the method of controlling the image forming apparatus 100 connected to the external device 200 via the external device interface unit 150, even though the descriptions are not provided here again.

In operation S1110, if supply of first power, generated by the power supply 130, to the image forming apparatus 100 is obstructed, the control unit 190 included in the image forming apparatus 100 may receive an input of power for the control unit 190 by using second power supplied from the external device 200 via the external device interface unit 150. In this case, the external device interface unit 150 may be a USB interface unit.

In operation S1120, the control unit 190 included in the image forming apparatus 190 may be driven by the power for the control unit 190, and may generate information about a power-supply state of the image forming apparatus 100, based on whether or not the first power is supplied from the power supply 130 and whether or not the second power is supplied from the external device 200. The information about the power-supply state of the image forming apparatus 100 may be stored in a register included in the control unit 190.

Then, the control unit 190 may receive a request for the information about the power-supply state of the first power from the external device 200 and transmit the generated information about the power-supply state of the image forming apparatus 100 to the external device 200. The information about the power-supply state of the image forming apparatus 100 may be information indicating that supply of the first power to the image forming apparatus 100 is obstructed.

Alternatively, if control unit 190 included in the image forming apparatus 190 receives a print job from the external device 200, the control unit 190 may control the power supply 130 to supply a plurality of pieces of power including the first power to the image forming apparatus 100 and control the image forming unit 160 to perform the received print job.

Alternatively, if user manipulation is input to the user input unit 120 included in the image forming apparatus 100, the control unit 190 included in the image forming apparatus 190 may control the power supply 130 to resume the supply of the first power.

When the power of the image forming apparatus 100 and the power of the external device 200 are in an OFF state, if the external device 200 is turned on, and thus, the second power is supplied from the external device 200 to the image forming apparatus 100 via the external device interface unit 150, the control unit 190 included in the image forming apparatus 100 receives an input of the power for the control unit 190, which is generated by using the supplied second power, and performs booting of the image forming apparatus 100, other than warming-up of the image forming apparatus 100. After the plurality of pieces of power that include the first power are supplied from the image forming apparatus 100, the control unit 190 included in the image forming apparatus 100 may control the warming-up of the image forming apparatus 100.

As described above, according to the one or more of the above exemplary embodiments, even when main power is not supplied to an image forming apparatus, a control unit included in the image forming apparatus may be driven to respond to a user request for operation of the image forming apparatus, and thus, user convenience may be enhanced.

In addition, other exemplary embodiments can also be implemented through computer-readable code/instructions in/on a medium, e.g., a computer-readable medium, to control at least one processing element to implement any above-described exemplary embodiment. The medium can correspond to any medium/media permitting the storage and/or transmission of the computer-readable code.

Processes, functions, methods, and/or software in apparatuses described herein may be recorded, stored, or fixed in one or more non-transitory computer-readable storage media (computer readable recording medium) that includes program instructions (computer readable instructions) to be implemented by a computer to cause one or more processors to execute or perform the program instructions. The media may also include, alone or in combination with the program instructions, data files, data structures, and the like. The media and program instructions may be those specially designed and constructed, or they may be of the kind well-known and available to those having skill in the computer software arts. Examples of non-transitory computer-readable storage media include magnetic media, such as hard disks, floppy disks, and magnetic tape; optical media such as CD ROM disks and DVDs; magneto-optical media, such as optical disks; and hardware devices that are specially configured to store and perform program instructions, such as read-only memory (ROM), random access memory (RAM), flash memory, and the like. Examples of program instructions include machine code, such as produced by a compiler, and files containing higher level code that may be executed by the computer using an interpreter. The program instructions may be executed by one or more processors. The described hardware devices may be configured to act as one or more software modules that are recorded, stored, or fixed in one or more computer-readable storage media, in order to perform the operations and methods described above, or vice versa. In addition, a non-transitory computer-readable storage medium may be distributed among computer systems connected through a network and computer-readable codes or program instructions may be stored and executed in a decentralized manner. In addition, the computer-readable storage media may also be embodied in at least one application specific integrated circuit (ASIC) or Field Programmable Gate Array (FPGA).

It should be understood that exemplary embodiments described therein should be considered in a descriptive sense only and not for purposes of limitation. Descriptions of features or aspects within each exemplary embodiment should typically be considered as available for other similar features or aspects in other exemplary embodiments.

While one or more exemplary embodiments have been described with reference to the figures, it will be understood by those of ordinary skill in the art that various changes in form and details may be made therein without departing from the spirit and scope as defined by the following claims and their equivalents.

What is claimed is:

1. An image forming apparatus comprising:

a power supply to generate power for the image forming apparatus;

an external device interface unit to connect an external device to the image forming apparatus;

a driving unit to generate power, by using first power supplied from the power supply or second power supplied from the external device via the external device interface unit; and a control unit which is driven by the generated power and which generates information about a power-supply state of the image forming apparatus based on whether the first power is supplied or whether the second power is supplied, wherein the driving unit generates the power for the control unit by using the second power, if supply of the first power is obstructed.

2. The image forming apparatus of claim 1, wherein the control unit receives a request for the information about the power-supply state of the image forming apparatus from the external device and the control unit transmits the generated information about the power-supply state of the image forming apparatus to the external device.

3. The image forming apparatus of claim 2, wherein the generated information about the power-supply state of the image forming apparatus indicates that the supply of the first power is obstructed.

4. The image forming apparatus of claim 1, further comprising an image forming unit to execute a print job, wherein, if the control unit receives the print job from the external device, the control unit controls the power supply to supply a plurality of pieces of power including the first power to the image forming apparatus and the control unit controls the image forming unit to perform the print job.

5. The image forming apparatus of claim 1, further comprising a user interface unit configured to receive input from user manipulation, wherein the control unit controls the power supply to resume the supply of the first power, if the user manipulation is input to the user interface unit.

6. The image forming apparatus of claim 1, wherein the control unit transceives information with the external device via the external device interface unit, if the external device is turned on and the second power is supplied from the external device via the external device interface unit.

7. The image forming apparatus of claim 6, wherein the control unit controls warm-up of the image forming apparatus, after the plurality of pieces of power including the first power are supplied from the power supply to the image forming apparatus.

8. The image forming apparatus of claim 1, wherein the control unit comprises:

a power-supply state detection unit which generates information about the power-supply state of the image forming apparatus, based on the whether the first power is supplied or the whether the second power is supplied;

a power-supply state transceiving unit which receives a request for the information about the power-supply state of the image forming apparatus from the external device; and a central processing unit (CPU) which transceives the generated information about the power-supply state of the image forming apparatus to the external device via the power-supply state transceiving unit, in response to the request for the information about the power-supply state of the image forming apparatus.

9. The image forming apparatus of claim 8, wherein the CPU comprises a register for storing the generated information about the power-supply state of the image forming apparatus.

10. The image forming apparatus of claim 1, wherein the external device interface unit is a universal serial bus (USB) interface unit.

11. A method of controlling an image forming apparatus connected to an external device via an external device interface unit, the method comprising:

generating power by using second power supplied from the external device via the external device interface unit, if supply of first power supplied from a power supply is obstructed; and driving a control unit by the generated power and generating information about a power-supply state of the image forming apparatus based on whether the first power is supplied or whether the second power is supplied.

12. The method of claim 11, further comprising:

receiving a request for the information about the power-supply state of the image forming apparatus from the external device, and transmitting the generated information about the power-supply state of the image forming apparatus to the external device.

13. The method of claim 12, wherein the generated information about the power-supply state of the image forming apparatus indicates that the supply of the first power is obstructed.

14. The method of claim 11, further comprising:

controlling the image forming apparatus to supply a plurality of pieces of power including the first power to the image forming apparatus, if a print job is received from the external device; and controlling an image forming unit to execute the received print job.

15. The method of claim 11, further comprising controlling the power supply to resume the supply of the first power, if user manipulation is input to a user interface unit for inputting user manipulation.

16. The method of claim 11, wherein the generating of the power for the control unit comprises:

receiving the second power from the external device via the external device interface unit, if the external device is turned on; and generating the power for the control unit by using the supplied second power, and further comprising transceiving of information with the external device via the external device interface unit.

17. The method of claim 16, further comprising controlling warming-up of the image forming apparatus, after the plurality of pieces of power including the first power are supplied from the power supply to the image forming apparatus.

18. The method of claim 11, further comprising storing the generated information about the power-supply state of the image forming apparatus.

19. The method of claim 11, wherein the external device interface unit is a universal serial bus (USB) interface unit.

20. At least one non-transitory computer readable medium storing computer readable instructions that when executed control at least one processor to implement the method of claim 11.

* * * * *